United States Patent [19]

Schmidt

[11] 4,009,796

[45] Mar. 1, 1977

[54] STORAGE LOCKER

[75] Inventor: Dietrich F. Schmidt, Carlisle, Pa.

[73] Assignee: Capitol Products Corporation, Mechanicsburg, Pa.

[22] Filed: Aug. 20, 1975

[21] Appl. No.: 606,184

[52] U.S. Cl. ..... 220/84; 312/257 A; 312/290; 220/345

[51] Int. Cl.[2] ..... B65D 7/42; B65D 43/20

[58] Field of Search ..... 308/3.6, 3.7, 3.8, 3.9; 312/138 R, 290, 257 SK, 341 NR, 263, 349, 257 A, 291, 138, 140; 49/409, 410, 411, 404; 52/657; 220/4 F, 84, 345, 346; 217/12 R, 13

[56] References Cited

UNITED STATES PATENTS

| | | | |
|---|---|---|---|
| 1,251,719 | 1/1918 | Wege | 312/107 |
| 1,511,613 | 10/1924 | Joern | 220/345 |
| 1,849,273 | 3/1932 | Broderick | 52/657 |
| 2,226,112 | 12/1940 | Blechman | 312/260 |
| 2,378,267 | 6/1945 | Waller | 217/12 R |
| 2,503,562 | 4/1950 | Porter | 220/1.5 |
| 2,815,252 | 12/1957 | Baker | 308/3.6 |
| 2,835,539 | 5/1958 | Conrad | 308/3.6 |
| 3,150,903 | 9/1964 | Chapman et al. | 220/84 |
| 3,250,582 | 5/1966 | Kassimir | 312/108 |
| 3,320,003 | 5/1967 | Edelson et al. | 308/3.6 |
| 3,321,253 | 5/1967 | Everburg | 308/3.6 |
| 3,736,035 | 5/1973 | Brown et al. | 312/107 |
| 3,846,001 | 11/1974 | Kaplan et al. | 308/3.6 |
| R26,165 | 2/1967 | Stolz | 52/82 |

FOREIGN PATENTS OR APPLICATIONS

| | | | |
|---|---|---|---|
| 188,273 | 2/1956 | Austria | 217/12 R |
| 30,011 | 1/1926 | France | 220/345 |
| 1,155,054 | 9/1963 | Germany | 220/4 F |

OTHER PUBLICATIONS

"Stor–All Locker," by Maclen Products Inc., N.Y., Sunday News, Apr. 19, 1970, p. 14b.

*Primary Examiner*—George E. Lowrance
*Assistant Examiner*—Allan N. Shoap
*Attorney, Agent, or Firm*—Donald L. Johnson; John F. Sieberth; Paul H. Leonard

[57] ABSTRACT

A multi-use indoor/outdoor storage locker comprising a rectangular box-like frame, a plurality of panels affixed to said frame, and a top lid and a front door, each of which has rigid plastic runners thereon and which are smoothly slidable into an open or closed position.

22 Claims, 7 Drawing Figures

STORAGE LOCKER

BACKGROUND OF THE INVENTION

The present invention is in the general field of cabinet structures or storage containers. Storage lockers or enclosures are customarily made of metal or wood or a combination of the two and are suitable for storing such items as trash cans, fire logs, garden tools, lawn chairs, paint cans, swimming pool filter systems, and other equipment and tools. The most common lockers or containers are box-like in shape, have a hinged top lid or roof which can be raised and lowered and a pair of hinged double-front doors. Such containers require a substantial amount of hardware such as hinges, handles, keepers, fasteners and the like.

It is therefore a primary object of the instant invention to provide a storage locker which eliminates the need for hardware.

Another object of the invention is to provide a storage locker or container suitable for a multiple or variety of uses, both indoors and outdoors.

A further object of the invention is to provide a storage locker which has clean lines of construction, is durable, attractive and economical.

Other objects and advantages of the present invention will become more readily apparent from a consideration of the description and drawings hereinafter.

SUMMARY OF THE INVENTION

The instant invention comprises a rectangular box-like frame, preferably of extruded aluminum, a plurality of panels, preferably of steel, affixed thereto, a top lid and a front door similarly constructed, i.e., a metal frame with metal panels affixed thereto, and rigid plastic runners snapped in place on the lid and door for providing slidable movement of the lid and door on their respective adjacent frame members. The invention eliminates the necessity for hardware such as hinges, handles, keepers, fasteners and the like.

The invention provides a multi-use indoor/outdoor storage locker which has neat, clean lines of construction.

The construction designed to carry out the invention, together with other features thereof is more detailedly described hereinafter.

DESCRIPTION OF THE PREFERRED EMBODIMENT

Figure 1:
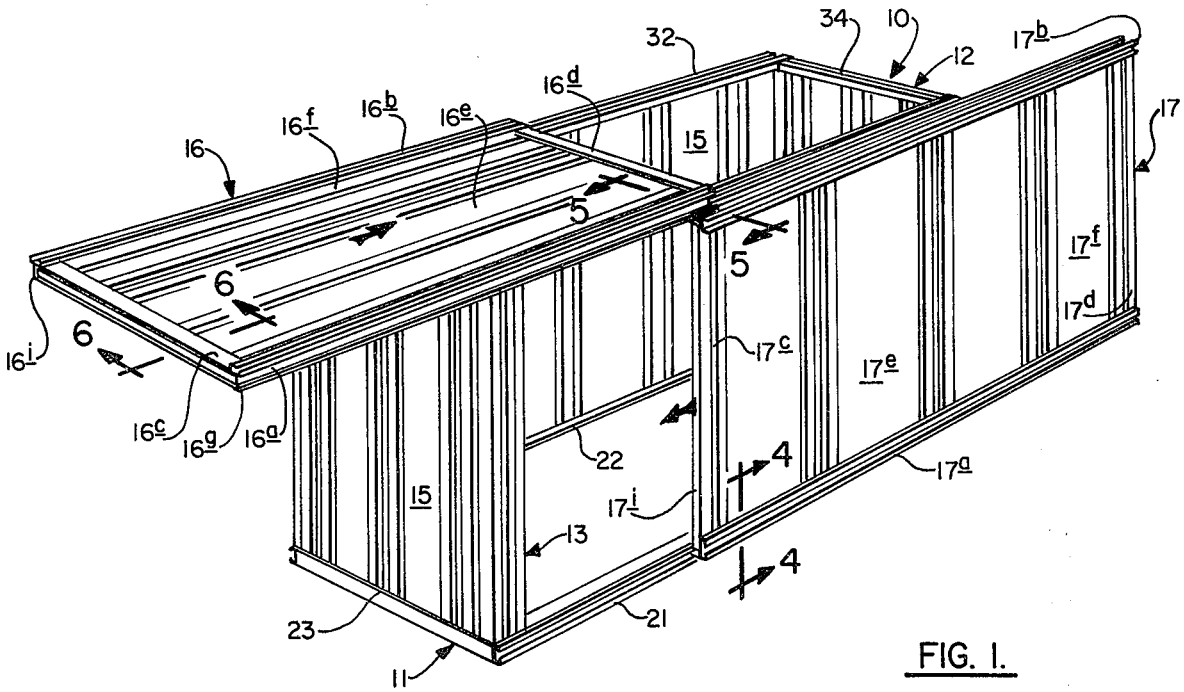
FIG. 1 is a perspective view of the storage locker of the present invention with the top lid and front door in a partially open position.

Referring now to the drawings and particularly to FIG. 1, the storage locker or container is indicated generally at 10. The locker 10, comprises a base frame 11, a top frame 12, a pair of upright wall jambs 13 and 14 (See FIGS. 2 and 3), a plurality of wall panels 15, a sliding lid 16 and a sliding front door 17. A plywood floor (not shown) may be installed in the base framing, if desired. The locker is so constructed that the top lid 16 and front door 17 may be completely slidably removed or installed. Plywood sheeting may be substituted for the lid, thus converting the locker to a table.

Figure 2:
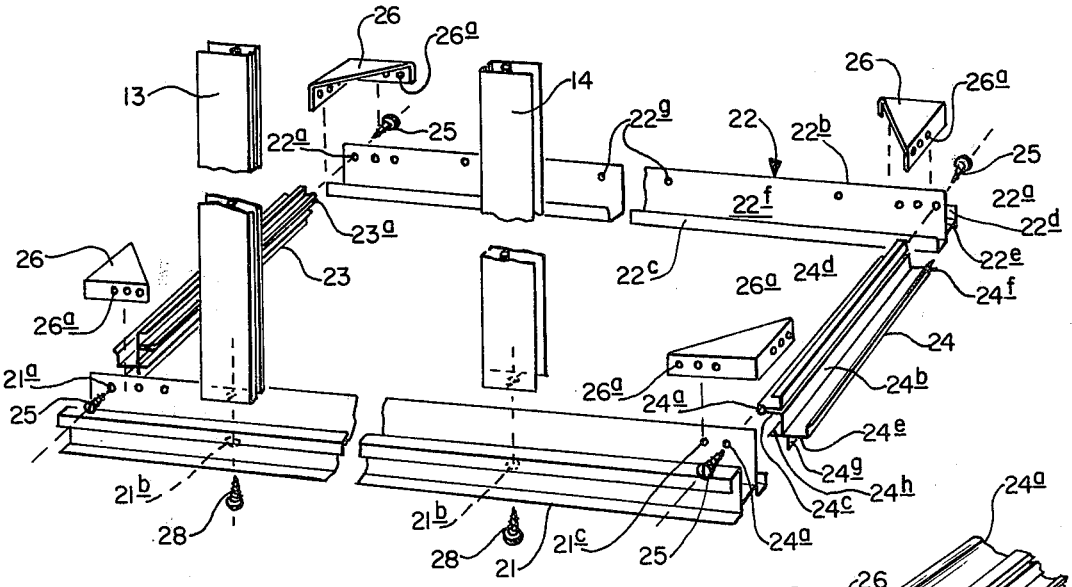
FIG. 2 is an exploded view illustrating the base framing and corner brace angles of the storage locker of the instant invention and the assembly thereof.
Figure 2A:
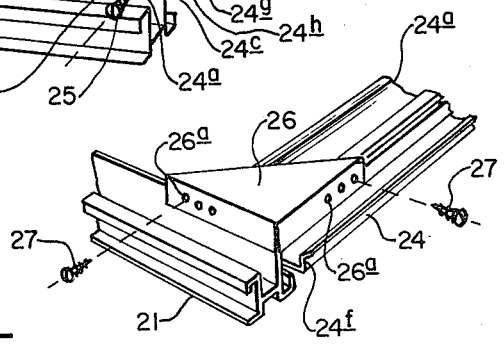
FIG. 2A is an enlarged partially perspective view showing details of the assembly of a corner brace angle on the front base frame and a side base frame.

As best seen in FIG. 2, the base frame 11 comprises a front base frame member 21, a rear base frame member 22 and a pair of side base frame members 23 and 24, rectangularly joined together by four base frame screws 25 or other suitable fasteners. Each of the side base framing members 23 and 24 has a frame screw receiving channel or groove **23*a* and 24*a*, respectively, which extend longitudinally the length thereof. Openings 21*a* and 22*a* are provided on each end of the framing members 21 and 22, respectively, for receiving the screws 25. Preferably, four corner brace angles 26 are installed over the four corners of the base framing 11 for additional strength and rigidity. When plywood flooring is used, the corner brace angles are not installed. The flooring is installed on the base frame 11** and screwed thereto upon subsequent panel screw installation, which is explained hereinafter.

The corner brace angles 26 have a plurality of holes **26*a* therein for receiving panel screws 27. Eight panel screws 27, one on each side of each corner brace angle, are employed to secure the corner brace angle over the four corners of the base framing 11**.

The corner brace angles are preferably of aluminum, but may be constructed from steel or other suitable materials. They are merely included to provide additional strength and rigidity to the locker and may be completely omitted if desired.

Each of the upright wall jambs 13 and 14 have a frame screw channel or groove **13*a* and 14, respectively, extending longitudinally the length thereof. The jambs 13 and 14 are vertically or perpendicularly fastened to the front base frame member 21 by jamb frame screws 28. Suitable holes or openings 21*b* are formed in the member 21 for receiving the screws 28**.

Figure 3:
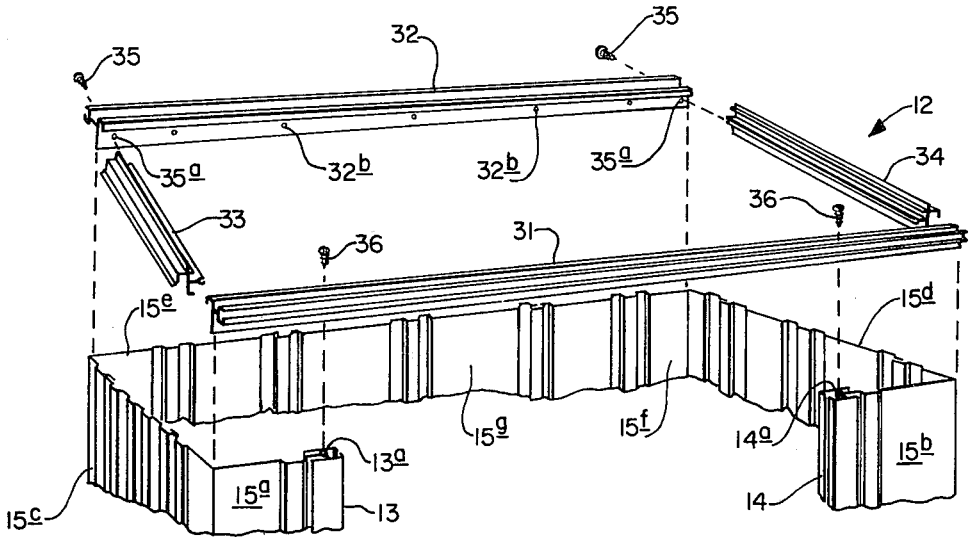
FIG. 3 is an exploded perspective view illustrating the top frame construction and assembly.

Referring now to FIG. 3, the top frame 12 comprises front top frame member 31, rear top frame member 32, and a pair of side top frame members 33 and 34, rectangularly joined together by four top frame screws 35 or other suitable fasteners. Each of the side top framing members 33 and 34 has a frame screw receiving channel or groove **33*a* and 34*a*, respectively, which extends the length thereof. Openings 31*a* (not seen) and 32*a* are provided on each end of framing members 31 and 32, respectively, for receiving the screws 35**.

A plurality of wall panels 15 are inserted in channels in the base frame 21 and attached thereto by panel screws or other suitable fasteners. The embodiment shown in FIG. 3 comprises a pair of short corner panels **15*a* and 15*b* installed in each front corner, a pair of full wall panels 15*c* and 15*d* on each side, a pair of long corner panels 15*e* and 15*f* installed in each rear corner and another full wall panel 15*g* in the rear between panels 15*e* and 15*f***. Suitable openings for receiving the panel screws are provided in each end of the various panels. The longitudinal edges of adjacent panels are assembled in an overlapping arrangement.

The top frame 12 is positioned over the upright wall panels 15 with the panels inserted in channels in the top frame. The frame 12 is attached to the panels 15 by means of the panel screws and by frame screws 36 inserted in openings in the front top frame member and into the screw channels 13*a* and 14*a* of the wall jambs 13 and 14, respectively.

Referring again to FIG. 1, the sliding lid assembly or top lid 16, comprises lid side rails 16*a* and 16*b*, lid end rails 16*c* and 16*d*, wide lid panel 16*e* and narrow lid panel 16*f*. The lid panels are arranged so that a longitudinal edge of one overlaps the adjacent longitudinal edge of the other and the side and end rails are rectangularly assembled therearound. Openings are provided in each end of the side rails for receiving frame screws. Frame screw channels are provided in each end rail which extend longitudinally the length thereof. Additionally, the lid 16 includes a pair of plastic guide or sash runners 16*g* and 16*h* on the side rail 16*a* and a similar pair of plastic guide runners 16*i* and 16*j* on side rail 16*b*. The runners 16*g* and 16*i* extend the lengths of lid frame members 16*a* and 16*b*, respectively, to which they are attached. The runners 16*h* and 16*j* are somewhat shorter in length than the runners 16*g* and 16*l*. The shorter runners are attached to the members 16*a* and 16*b* in an intermediate position thereon so as to fit between the end rails 16*c* and 16*d* when the lid 16 is completely assembled. The lid 16 is slidably mounted on the top frame 12 and suitable grooves or channels are constructed in each so as to accomplish this purpose. The plastic guide runners provide a bearing surface for sliding movement of the lid, with a minimum of friction.

The sliding front door or door assembly comprises a bottom door frame 17*a*, a top door frame 17*b*, a pair of door end rails 17*c* and 17*d*, and door panels 17*e* and 17*f*. The door panels are arranged so that a longitudinal edge of one overlaps the adjacent longitudinal edge of the other and the bottom frame, top frame and end rails are rectangularly assembled therearound. Openings are provided in each end of the top and bottom door frames for receiving frame screws. Frame screw channels are provided in each door end rail which extend longitudinally the length thereof. The door 17 also includes a pair of plastic guide runners 17*g* and 17*h* mounted on the frames 17*a* and 17*b*, respectively. The runners 17*g* and 17*h* extend the lengths of their respective frame members or frames 17*a* and 17*b*. Snap-on plastic door seals or covers are installed on each door end rail 17*c* and 17*d*, respectively. The door seals provide a finished touch to the front door and cover any exposed open areas on the end rails. The door 17 is slidably mounted on the front base frame member 21 and front top frame member 31. Suitable channels are constructed in each frame member so as to effect the slidable mounting. The plastic guide runners provide a bearing surface for slidable movement of the door, with a minimum of friction.

All of the framing members, i.e., front and rear base frame members, side base frame members, front and rear top frame members, side top frame members, wall jambs, top lid front and back rails, top lid end rails, top and bottom door frames and door end rails are all preferably extruded aluminum shapes. All of the panels, i.e., wall panels, lid panels and door panels are preferably rolled coated steel paneling. It can be appreciated that other materials may also be suitable, such as e.g., aluminum, plastic or wood panels and plastic or steel framing members.

The plastic guides or runners installed on the lid and door, may be made from any suitable plastic such as nylon, vinyl and the like. Other materials may be used, the only criteria being that the installed runners permit door and lid panels to glide smoothly in open and closing sliding movements.

Frame screws and panel screws are preferably self tapping, with the former being somewhat larger than the latter. Washers are preferably used with the panel screws, but are not recommended for use with the frame screws. Screw end covers made from short sections of plastic or rubber tubing, preferably vinyl are installed over exposed screw ends as an added safety feature.

Figure 4:
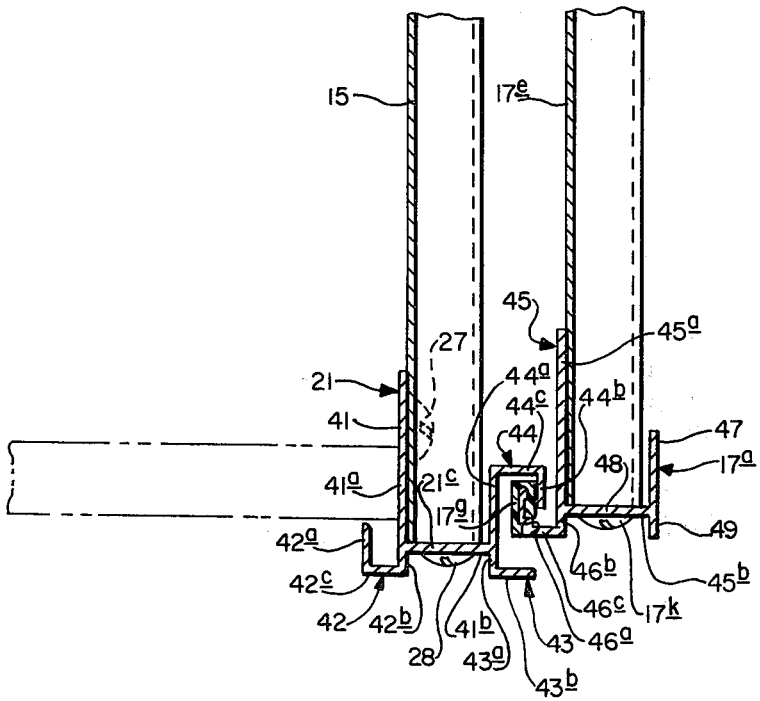
FIG. 4 is an enlarged sectional view taken along line 4—4 of FIG. 1.

The details of construction of the front base frame member 21 with bottom door frame 17*a* slidably engaged thereon are best seen in FIG. 4. The member 21 is a one-piece aluminum extrusion or extruded aluminum shape. As seen in cross-section, the shape 21 is formed so that it has a central angle member 41 of unequal legs 41*a* and 41*b*. A hook or U-shaped member 42 of unequal length legs 42*a* and 42*b* extends from one end of the leg 41*a*. The legs 42*a* and 42*b* are joined together by a web 42*c*. The legs 41*a* and 42*b* are vertically aligned. A smaller angle member 43 having unequal legs 43*a* and 43*b* extends perpendicularly from the end of the leg 41*b*. The legs 42*c* and 43*b* are spaced apart and in horizontal alignment. These legs form the base or feet on which the storage locker rests when assembled. The legs 42*b* and 43*a* are spaced apart and in parallel alignment.

A larger hook or U-shaped member 44 having unequal legs 44*a* and 44*b* joined together by web 44*c* extends from the end of leg 41*b* opposite short leg 43*a* and in vertical alignment with leg 43*a*. Long leg 44*a* is spaced apart from long leg 41*a* and is parallel thereto. The legs 41*a* and 44*a* form a channel 21*d* for receiving panels 15. Openings 21*c* are spaced apart and appropriately located on long leg 41*a* so as to match screw openings in the panels 15 and receive panel screws 27. Jamb screw openings 21*b* are also appropriately located in the leg 41*b* for receiving jamb screws 28.

As best seen in FIG. 2, the rear base frame member 22 is also a one-piece extruded aluminum shape. The portion thereof facing the interior of the storage locker is constructed similar to that part of the member 21 which also faces the interior of the locker. Since no door is installed on the member 22, the exterior portion thereof is more simply constructed than the exterior portion of the member 21. In cross-section, the shape 22 has a central angle member 22*b* similar to the member 41 and a U-shaped or hook member 22*c* similar to the member 42. A flange 22*d* extends perpendicularly from the end of the short leg 22*e* of angle member 22. The flange 22*d*, long leg 22*f* and short leg 22*e* form a channel for receiving panel members 15. Openings or holes 22*g* are appropriately located in the member 22*f* for receiving panel screws for attaching the panels to the frame member 22.

The side base frame members 23 and 24 are substantially identical and are extruded aluminum shapes. In cross-section, member 24 comprises a main or vertical member 24*b* having a U-shaped channel member 24*c* formed therein and with each leg thereof extending perpendicularly inward. The frame screw channel 24*a* is formed on the end or base of the U-shaped channel member 24c. Preferably, the interior of the member 24c is serrated or has a plurality of longitudinally extending grooves on the legs thereof. A short flange 24d extends perpendicularly and inwardly from the upper end of the member 24b. A long flange 24e extends perpendicularly and outwardly from the lower end of the member 24b. An obtuse angle member 24f extends perpendicularly and upwardly from the outer end of the flange 24e. A vertical leg member 24g extends perpendicularly and downwardly from the flange 24e and provides a base for the frame member 24. The angle member 24f, flange 24e and main member 24b form a channel for receiving wall panels 15. A short flange 24h also extends inwardly from the lower end of the main member 24b opposite of long flange 24e. Suitable holes are appropriately located in the member 24b for alignment with holes in the panels for receiving panel screws for attachment of the panels to the member 24.

The front top frame member 31 is constructed similarly to the front base frame member 21. The member 31 is installed opposite the member 21 so that the panel receiving channel thereof is opposite of and in alignment with the panel receiving channel 21c of member 21. A cross-section of the member 31 may be seen in FIG. 5.

The rear top frame member 32 is constructed similarly to the top and bottom front frame members 31 and 21. Since more wall panels 15 are attached to the rear of the locker than the front, additional panel screw receiving holes 32b are appropriately spaced in the member 32.

Top side frame members 33 and 34 are constructed similarly to side base frame members 23 and 24. The members 33 and 34 are positioned so that their panel receiving channels are opposite and in alignment therewith, respectively, the panel receiving channels in the members 23 and 24.

The bottom door frame 17a is a one-piece extruded aluminum shape. A cross-section thereof is best seen in FIG. 4. The shape 17a is formed so that it has a central angle member 45 having unequal legs 45a and 45b. A hook or U-shaped member 46 having unequal legs 46a and 46b joined together by web 46c extends from one end of the long leg 45a. The legs 45a and 46b are in alignment with each other. A flange 47 extends at a right angle from the end of the leg 45b and is parallel to and spaced apart from the long leg 45a. Flange 47, leg 45b and leg 45a form a channel 48 for receiving door panels 17e and 17f. Long leg 45a has panel receiving openings or holes spaced apart and suitably located therein for receiving panel screws for attachment of the door panels to the frame member 17a.

A short flange 49 is attached at a right angle to leg 45b and opposite of and this in alignment with flange 47. Holes or openings are located in each end of the leg 45b for receiving frame screws 17k which join the frame 17a with end rails 17c and 17d, respectively.

Plastic guide runner 17g is attached to hook member 46 on the leg 46a thereof. Preferably, the leg 46a has a notch on each side thereof. The plastic guide runner preferably has a projection on each end thereof for mating with the notches on the leg 46a. The notched construction of the leg 46a is substantially identical to that of leg 52a of U-shaped member 52 seen in FIG. 5.

The top door frame 17b is constructed similarly to the bottom door frame 17a. It is installed over the door panels 17e and 17f so that the panel receiving channel of frame 17b is opposite of and in alignment with panel receiving channel 48 of frame 17a. A cross-section of the frame or member 17b is seen in FIG. 5.

The door end rails 17c and 17d are extruded aluminum shapes and are substantially identical in cross-section with wall jambs 13 and 14 and top lid end rails 16c and 16d. Rail 16c is described in detail hereinafter. The lengths of the various shapes varies with the particular dimensions of the locker 10.

Figure 5:
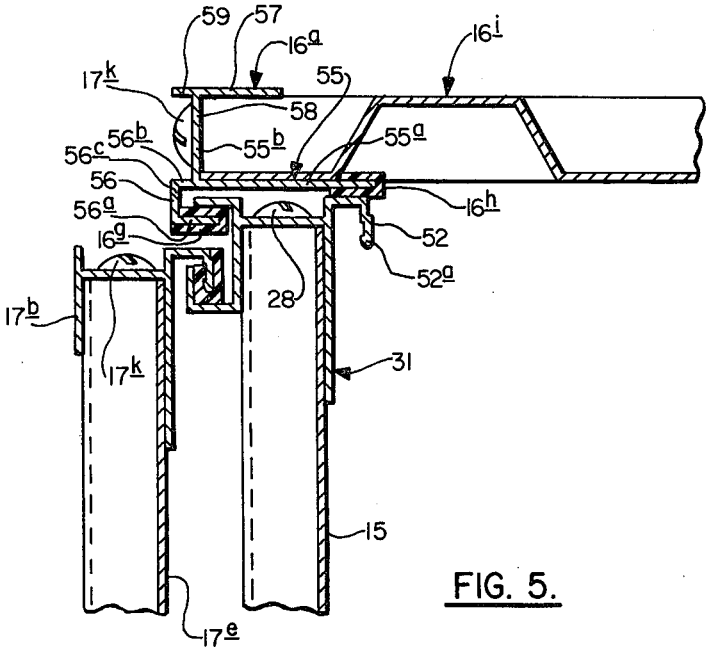
FIG. 5 is an enlarged sectional view taken along line 5—5 of FIG. 1; and, FIG. 6 is an enlarged sectional view taken along line 6—6 of FIG. 1.

A cross-section of the top lid front side rail 16a is shown in FIG. 5. It is also a one-piece extruded aluminum shape. In cross-section, the lid rail 16a is substantially identical to rear base frame member 22, bottom door frame 17a and top door frame 17b. The shape 16a includes a central angle member 55 having unequal legs 55a and 55b. A hook or U-shaped member 56 having unequal legs 56a and 56b joined together by web 56c extends from one end of long leg 55a. The legs 55a and 56b are in alignment with each other. A flange 57 extends at a right angle from the end of short leg 55b and in parallel to and spaced apart from long leg 55a. Flange 57, short leg 55b and long leg 55a form a channel 58 for receiving lid panels 16e and 16f. Long leg 55a has panel receiving openings or holes spaced apart and suitably located therein for receiving panel screws for attachment of the panels to the frame member 16a.

A short flange 59 extends at a right angle from leg 55b and opposite of and in alignment with flange 57. Holes or openings are located in each end of the leg 55b for receiving frame screws 17k which join the rail 16a with end rails 17c and 17d, respectively.

Plastic guide runner 16g is attached to hook member 56 on the leg 56a thereof. The leg 56a has a notch on each side thereof for receiving projections on the runner 16g. The plastic guide runner 16g is snapped on the member 56 and is lockedly engaged thereon. The notched construction of the leg 56a is substantially identical to that of leg 52a of U-shaped member 52. The lid 16a has another plastic guide runner 16h positioned on the end of the long leg 55a of central angle member 55. The end of leg 55a on which the runner 16h is locked thereon is notchedly constructed similar to the leg 52a.

The top lid back or rear side rail 16b is constructed substantially identical to the rail 16a and plastic guide runners 16i and 16j are similarly positioned thereon.

Figure 6:
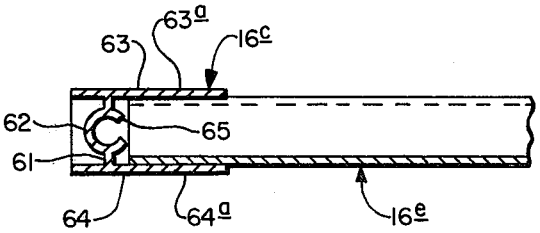

Top lid end rail 16c is viewed in cross-section in FIG. 6. The rail 16c is an extruded aluminum shape and has a central member or web 61 with a longitudinally extending frame screw receiving channel 62 formed thereon. Flanges 63 and 64 extend perpendicularly from each end of the web 61 and are parallel to and spaced apart from each other. A lid panel receiving channel 65 is formed by end portion 63a of flange 63, web 61 and end portion 64a of flange 64. Shape 16d is substantially identical to shape 16c.

As best seen in FIGS. 5 and 6, the plastic guide runners provide a plastic to metal contact for all sliding movement of both lid and door. All metal to metal contact on bearing surfaces is eliminated. Such construction provides for a minimum of friction as lid and/or door are slidably moved.

Assembly of the various component parts of the storage locker is carried out in the following preferable manner. Front, rear and side base frame members are attached at their respective corners using four frame screws. If a plywood flooring is to be used, it is installed at this point and corner brace angles are not used. Subsequent panel screw installation will secure the floor. Should flooring not be available at this time, it can be laid into position loosely after assembly is complete. If flooring is not employed at this time, corner brace angles are installed over the four corners of the base framing. This is accomplished using eight panel screws, two to each angle using appropriate holes therefor.

Next, the two upright wall jambs, which are longer than the similarly shaped door end rails, are positioned over the screw holes in the recess or channel of the front base frame, with the open legs thereof facing the corners of the locker. Each jamb is secured in place with a frame screw.

Wall panels are then positioned. Beginning at the right front of the locker, a short corner panel is positioned in the channel therefor of the right upright wall jamb and down into the wall receiving channel of the front and side base frame members. A full wall panel is then positioned beside the corner panel, overlapping the adjacent edges of the panels. Panel screws are installed where appropriate in the holes provided therefor. Preferably, the panel screws at sides of locker are not tightened until all panels are positioned and screwed. Thereafter a long corner panel is positioned beside the full wall panel in the channels therefor in the side and rear base frame members. Additional panels are positioned consecutively with overlapping edges ending up with a short corner panel at the left front of the locker with its edge inserted into the receiving channel of the left upright wall jamb. Panel screws are installed thru the bottom panels and into the base frames in the holes provided therefor.

The front, rear and side top frame members are assembled at the corners thereof with four frame screws. The top frame is then positioned over the top edges of the wall panels. Panel screws are applied thru the tops of the panels and into the top frame members using the appropriate holes therefor. Preferably, the rear of the locker is secured first, then the front and finally the sides. The top of the locker is completed by installing two frame screws down thru the front top frame member and into each of the upright wall jambs.

The sliding lid is assembled next. Short and wide lid panels are positioned so that one panel rib overlaps the adjacent rib on the other panel. The ends of the panel are inserted into the open legs or panel receiving channels of the lid end rails. Appropriate runners of the lid front and back side rails are positioned over the outer ends of the lid end rails and the lid panels with the hooks or of the side rails being down. The lid framing is secured by installing four frame screws, one in each corner thereof. Plastic guide runners are then installed on the lid side rails. Two longer runners are applied to the hooks of the side rails and two shorter runners are applied to the long legs of the side rails. No screws are installed in the lid panels.

Plastic door seals are slidably engaged on each of the two door end rails. Door panels are positioned so that only the leading edges thereof overlap. Top and bottom ends of the door panels are positioned into the top and bottom door frames, in respective channels therefor, being sure that the hooks are positioned down. Door end rails are applied over the sides of the door panels and into the top and bottom door frames. The door framing is secured by installing four frame screws, one in each corner of the frame. No screws are installed into the door panels. The door seals are installed so that the wide part of the seal faces down during assembly. Plastic guide runners are applied to the hook edges of the top and bottom door frame members.

Then, preferably, a length of tubular vinyl material of appropriate size is positioned over each exposed screw end and then cut off, thus protectively covering all screw ends.

Finally, the sliding door is engaged with its mating rails at the front (top and bottom) of the locker. Similarly, the sliding lid is engaged with its mating rails at both sides of the top of the locker. Any raw edges on metal framing should be smoothed by filling or the like to prevent damage to the plastic guide runners.

Wall panels, door panels and lid panels are preferably constructed from rolls of sheet steel or aluminum. As illustrated, the panels are of a corrugated design to provide strength and stability. The lengths of panels, number of panels and types of panels are dictated largely by the desired dimensions of the locker and the end use thereof. Preferably, the panels are also painted or otherwise coated with a protective and/or decorative finish.

The present invention provides for a storage locker having a wide variety of uses and which is attractive as well as useful. The sliding top lid and sliding front door provide ready access to the top and the front of the locker. The lid and door may be readily and easily quickly opened and/or completely removed. Closing and installation are as easily accomplished.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A storage locker comprising a base frame, a top frame, a plurality of panels joining said base frame to said top frame to form a rectangular box-like construction having an access opening within said top frame and a second access opening between said base frame and said top frame, a slidably movable horizontally and slidably removable horizontally lid horizontally mounted on said top frame, and a slidably movable horizontally and slidably removable horizontally door vertically mounted on said top frame and said bottom frame.

2. The storage locker of claim 1, comprising means on said lid for receiving plastic guide runners, means on said door for receiving plastic guide runners, plastic guide runners on each of said plastic guide runner receiving means, means on said top frame for slidably receiving said plastic guide runners receiving means on said lid and said plastic guide runners thereon, and means on said base frame and means on said top frame for slidably receiving said plastic guide runners receiving means on said door and said plastic guide runners thereon.

3. The storage locker of claim 1, wherein said slidably movable door comprises a bottom door frame, a top door frame, a pair of door end rails and a door panel; said bottom door frame, said top door frame and said pair of door end rails being joined together at the ends thereof to form a rectangular shaped door frame, said door panel being installed in said rectangular shaped door frame to form a complete door; plastic guide runner receiving means on the interior side of each of said top door frame and said bottom door frame extending longitudinally the lengths thereof; plastic guide runners mounted on each of said receiving means therefor extending substantially the length thereof; and means on said base frame and means on said top frame for slidably receiving said plastic guide runner receiving means with said plastic guide runners mounted thereon.

4. The storage locker of claim 3, wherein said door comprises at least two door panels vertically positioned in said rectangularly shaped door frame with adjacent edges of said panels in an overlapping arrangement.

5. The storage locker of claim 1, wherein said slidably movable lid comprises a lid front side rail, a lid back side rail, a pair of lid end rails and a lid panel; said rails being joined together at the ends thereof to form a rectangularly shaped lid frame, said lid panel being installed in said lid frame to form a complete lid; plastic guide runner receiving means on each side of said front side rail and on each side of said back side rail extending longitudinally the lengths thereof and paralleledly spaced apart from each other; plastic guide runners mounted on each of said receiving means therefor extending longitudinally the length thereof; and means on said top frame for slidably receiving said plastic guide runner receiving means with said plastic guide runners mounted thereon.

6. The storage locker of claim 5, wherein said lid comprises at least two lid panels longitudinally positioned in said rectangularly shaped lid frame with adjacent edges of said panels in an overlapping arrangement.

7. The storage locker of claim 1, wherein said rectangular box-like frame construction includes a pair of upright wall jambs connecting said base frame to said top frame and said second access opening is between said upright wall jambs as well as between said base frame and said top frame.

8. The storage locker of claim 1, wherein said base frame comprises a front base frame member, a rear base frame member and a pair of side base frame members, each of said base frame members being joined together at the ends thereof to form a rectangular shaped base frame.

9. The storage locker of claim 8, wherein rectangular brace angles are installed on each corner of said rectangular shaped base frame.

10. The storage locker of claim 1, wherein said top frame comprises a front top frame member, a rear top frame member, and a pair of side top frame members, each of said top frame members being joined together at the ends thereof to form a rectangular shaped top frame.

11. The storage locker of claim 1, wherein said base frame and said top frame each comprises a plurality of framing members and each of said framing members is an extruded aluminum shape.

12. The storage locker of claim 1, wherein each of said panels is a corrugated metal panel.

13. The storage locker of claim 1, wherein said base frame comprises a front base frame member, a rear base frame member and a pair of side base frame members, and each of said base frame members being connected together at the ends thereof to form a rectangular shaped base frame; said top frame comprises a front top frame member, a rear top frame member, and a pair of side top frame members, and each of said top frame members being connected together at the ends thereof to form a rectangular shaped top frame; and, said lid being mounted on said front top frame member and said rear top frame member and said door being mounted on said front top frame member and said front base frame member.

14. The storage locker of claim 13, wherein a corner brace angle is installed on each of the four corners of said rectangular shaped base frame whereby each corner brace angle is positioned on an end portion of a front or rear base frame member and an end portion of a side base frame member adjacent to said front or rear base frame member.

15. The storage locker of claim 13, wherein each of said base frame members and each of said top frame members has a panel receiving channel formed therein.

16. The storage locker of claim 13, wherein said front base frame member and said front top frame member each have a means thereon for receiving a plastic guide runner receiving means and plastic guide runner thereon on said door.

17. The storage locker of claim 13, wherein said front top frame member and said rear top frame member each have a means thereon for receiving a plastic guide runner receiving means and plastic guide runner thereon on said lid.

18. The storage locker of claim 1, wherein said base frame includes a front base frame member, a rear base frame member and a pair of side base frame members connected together at the ends thereof to form a rectangular shaped base frame; and said top frame includes a front top frame member, a rear top frame member and a pair of side top frame members connected together at the ends thereof to form a rectangular shaped top frame.

19. The storage locker of claim 18, wherein said front base frame member comprises in cross-section, a central angle member, a hook member extending downwardly therefrom, a second angle member extending downwardly from said central angle member and opposite said hook member, a second hook member extending upwardly from said central angle member and opposite of said second angle member, and, said second hook member being of a size and shape to receive a guide runner receiving means with a guide runner affixed thereto on said slidably movable front door.

20. The storage locker of claim 19, wherein said front top frame member is substantially identical in cross-section to said front base frame member.

21. The storage locker of claim 19, wherein said rear top frame member is substantially identical in cross-section to said front base frame member.

22. The storage locker of claim 18, wherein said rear base frame member comprises in cross-section, a central angle member, a hook member extending downwardly therefrom, and a flange extending upwardly and downwardly from said central angle member and opposite said hook member.

* * * * *

UNITED STATES PATENT OFFICE
CERTIFICATE OF CORRECTION

PATENT NO. : 4,009,796

DATED : March 1, 1977

INVENTOR(S) : Dietrich F. Schmidt

It is certified that error appears in the above-identified patent and that said Letters Patent are hereby corrected as shown below:

Column 3, line 26, "161" should read -- 16i --, Column 8, line 13, "filling" should read -- filing --, Column 9, line 45, "rectangular" should read -- corner --.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*